United States Patent [19]

Straub

[11] 4,034,585

[45] July 12, 1977

[54] PROCESS OF COMPRESSION STRESSING METALS TO INCREASE THE FATIGUE STRENGTH THEREOF

[76] Inventor: John C. Straub, 2508 Lincolnway West, South Bend, Ind. 46628

[21] Appl. No.: 607,241

[22] Filed: Aug. 25, 1975

[51] Int. Cl.[2] ..... C21D 7/06; B21B 1/00

[52] U.S. Cl. ..... 72/53; 72/362; 72/365

[58] Field of Search ..... 72/53, 40, 362, 365, 72/110, 199, 234

[56] References Cited

U.S. PATENT DOCUMENTS

| | | | |
|---|---|---|---|
| 2,077,639 | 4/1937 | Minich | 72/53 |
| 3,073,022 | 1/1963 | Bush | 72/53 |
| 3,573,023 | 3/1971 | Thomas | 72/53 |
| 3,701,677 | 10/1972 | Miyata | 72/53 |

*Primary Examiner*—C.W. Lanham

*Assistant Examiner*—Gene P. Crosby

*Attorney, Agent, or Firm*—Oltsch & Knoblock

[57] ABSTRACT

A process of compression stressing metals to increase the fatigue strength or resistance to brittle fractures thereof by shot peening or surface rolling wherein the elastic radial tensile stress of the metal is maintained at a safe low value at the time when subsurface yield incident to initial compression stressing occurs. Initial processing entails compression stressing of the metal under conditions imparting compression stresses of sufficiently low value to avoid the formation of superficial or surface cracks in notch-sensitive metals followed, where required, by final processing wherein the metal is subjected to compression stressing under conditions imparting compression stresses of sufficiently high value to produce a favorable distribution of residual compression stress and residual tensile stress for increase of the fatigue strength of the metal.

9 Claims, No Drawings

PROCESS OF COMPRESSION STRESSING METALS TO INCREASE THE FATIGUE STRENGTH THEREOF

SUMMARY OF THE INVENTION

This invention relates to a process of compression stressing metals to increase the fatigue strength thereof, and, more particularly, to prestressing metals by shot peening or surface rolling.

The processes of shot peening and surface rolling metals have been used for increasing the fatigue strength of metals on a production basis for many years. One of the major factors responsible for the increased fatigue strength of metals when so processed is the presence of a residual compressive stress of high magnitude in the surface of the part. In a metal part which does not contain such residual compressive stress in the surface, fatigue failure will start at the surface thereof. Such a fatigue failure is the result of repeated cycles of applied stress; that is, it occurs from fluctuation of the magnitude of the applied stress, or its direction, as between tensile stress or compressive stress, or both. The degree of change in stress during the stress cycle will influence the life before fatigue failure, as will also the magnitude of the maximum tensile stress during the cycle. The higher the maximum tensile stress the sooner fatigue failure will occur in terms of numbers of cycles. Fatigue failure is a brittle type of fracture which occurs substantially without plastic deformation in the area of fracture. Brittle fracture can occur as a result of a single application of high tensile stress. Shot peening generally is not recognized as a means of increasing the resistance of a component to yield as a result of a single cycle of high tensile stress. It follows then that insofar as the surface of the part is concerned a residual compressive stress at the surface will reduce the magnitude of the resultant tensile stress since the resultant stress is the algebraic sum of the tensile stress and the compressive stress. It is also known that a residual compressive stress in a metal part cannot exist without a corresponding residual tensile stress therein which resists the compressive stress.

A compression stressed metal part may be subject to failure either at the surface or below the surface, depending upon the distribution of the applied stress, the distribution of the residual stresses, the notch sensitivity of the material, and other factors. Fatigue failure is most likely to occur at the depth where the maximum resultant tensile stress of the part is greatest in relation to the fatigue strength of the material at that depth. The fatigue strength of the material is influenced by some function of the physical properties of the material and varies according to the composition of the material: for example, it varies as between metals whose hardness is constant through the cross section thereof and in which except at the surface the fatigue strength is constant through the cross section, and metals which are case hardened for maximum hardness at the surface and wherein the physical properties of the material influence the fatigue strength at the depth of maximum resultant tensile stress. The distribution of residual stress is difficult to determine on a quantitative basis, although residual stress at the surface can be measured rather easily, as with equipment employing X-ray diffraction. Investigations have been made, however, which indicate that under certain conditions the maximum compressive stress occurs at the surface of the part, whle under other conditions the maximum occurs in a subsurface location.

I have found that it is possible to obtain a spectacular gain in fatigue strength by compression stressing metal under conditions different from or in some cases exceeding those currently practiced. In this connection, I have found that the location of the maximum residual compressive stress depends upon the yield strength of the metal being worked; and, particularly in shot peening harder materials of 50Rc or above, such maximum residual compressive stress depends upon the velocity of the shot striking the work piece. Also, I have found that for steel of the lower hardness ranges the depth of the maximum residual compressive stress may be dependent upon the diameter of the spherical or other shot employed in the peening operation. There is a complex relationship of the factors involved, such as the properties of the metal, as between homogenous and case hardened metals; the range of hardness involved for the particular use or application of the part being worked; and the stress cycle involved in the service of the part, such as complete reversal of stress, or zero to maximum stress. Other involved factors are peening conditions, such as the shot diameter, the velocity of the shot, the hardness of the shot and the degree of coverage of the part by the shot.

The compression stressing of metals entails plastic flow of the metal being processed. This plastic flow during peening is always maximum below the surface, but in cases where the depth of maximum flow is sufficiently shallow, the residual compressive stress caused by that flow will be substantially maximum at and slightly below the surface. Another factor to be considered in shot peening metals of high strength is the magnitude of the radial tensile stress on the surface of the metal part occurring at or adjacent to the edge or periphery of the circular area of contact between the substantially spherical shot and the metal part during impact. This stress may be excessive before subsurface yield occurs and thus may result in damage to the notch-sensitive surface of the metal part. This is peculiar to components with homogenous hardness, as contrasted with case hardened steel. In considering the last named factor, in a ductile material the magnitude of radial tensile stress occurring at the surface of the part is relatively low when massive yield occurs in the subsurface region, and this yield gradually spreads and causes a residual compressive stress on the surface. This takes place before the elastic radial tensile stress becomes excessive. The radial tensile stress is about 40% of the maximum elastic shear stress which causes the initial plastic flow below the surface. In ductile metals compressive stress is set up in the surface before the radial tensile stress becomes significant, and therefore no cracks develop at the surface. When the notch-sensitivity of a metal part is low, it is evident that a part of thick cross section can be peened very effectively with high impact. I have found by extensive fatigue tests of soft steel, say 20 to 30Rc (Rockwell) that the fatigue strength of such a component increases with the severity of impact in a range far greater than any impact value used in shot peening operations at the present time.

With metals of high hardness, such at 50Rc or more, higher elastic stresses, including the radial tensile stress at the surface at the edge of the area of contact of the shot, will occur before subsurface yield occurs during impact. Calculations I have derived indicate that, as the hardness of the metal increases, the magnitude of the elastic tensile strength stress prior to subsurface yield increases; and the higher the hardness the higher the notch-sensitivity of the metal, so that cracks are likely to develop in the sudden application of this radial tensile stress. I have found that through-hardened high-strength steel is subject to a smaller increase of fatigue strength by peening than a similar metal which had been carburized to provide the typical hardness gradient resulting from the carburizing process.

As a result of my investigations, I have found that it is possible and it is the primary object of this invention to obtain a spectacular gain in fatigue strength by choice of conditions of compression stressing of metal in one or more stages to obtain a distribution of residual stresses in the metal not heretofore attained in compression stressing processes.

A further object of the invention is to provide a process of compression stressing metal under predetermined conditions of impact in shot peening, or of rolling pressure in surface rolling, which will produce a distribution of residual stresses for greater effective reduction of maximum resultant tensile stress than possible heretofore in relation to the fatigue strength of the metal at the point where maximum resultant tensile stress exists.

A further object is to provide a process of compression stressing metal in one or more stages under conditions which will cause a maximum plastic flow of the metal to occur at a depth which will produce an advantageous distribution of residual stresses to increase the fatigue strength of metal components beyond or greater than that expected or possible heretofore by the use of conventional compression stressing methods.

A further object is to provide a process of compression stressing metal in one or more stages which will produce a favorable distribution of residual stresses in the metal without the occurrence of damage to the surface in the form of cracks in the metal.

A further object is to provide a process of prestressing metal to produce a favorable distribution of compressive and tensile residual stresses in the metal to thereby augment or increase the gain in fatigue strength of the metal which would occur by conventional shot peening or surface rolling methods.

Other objects will be apparent from the following specification.

This method may be practiced by shot peening or by surface rolling. In both types of methods conditions are controlled or chosen to ensure that the elastic radial tensile stress is at a safe low value at the time when subsurface yield incident to the compression stressing occurs, thereby avoiding damage to the material. The process employing shot peening will first be described.

In one embodiment of the shot peening process two or more peening conditions are involved or practiced. Thus, an initial stage or step in the process entails peening under conditions in which the velocity of the substantially spherical shot is sufficiently low to avoid superficial or surface cracks during the peening operation. This is particularly important when peening parts of high strength steel. I have found that the occurrence of surface cracks during a peening operation is the result of the elastic radial tensile stress in the material due to impact. This tensile stress is primarily dependent upon the velocity of the shot and is substantially independent of the size of the shot, as long as the action of impact is entirely elastic. As soon as subsurface shear stress exceeds the yield strength of the metal in the work piece, plastic flow begins at the point of excess and spreads gradually. The spread of the plastic flow is predominantly toward a greater depth, but to some extent occurs also toward the surface of the piece. The subsurface shear stress occurs directly below the center of contact of the ball or shot on the work, and cracks are not likely to occur at that point because of the three-dimensional support of the solid material around the center of contact, even though at the instance of first yield, the magnitude of the contact compressive stress at that center point is almost three times as great as the subsurface shear stress. At the same instant the radial tensile stress which occurs at the edge or margin of contact, even though much smaller than the subsurface shear stress, may occur at an exposed surface at which cracks may occur. This, of course, does not imply that the radial tensile stress does not increase after the instant of first yield. In view of the last named factors, the initial stage in the practice of my method should be such that plastic flow of the metal begins before the radial tensile stress becomes excessive, i.e. it occurs at a sufficiently shallow depth to produce a residual compressive stress at the surface of the work. The residual compressive stress at the surface need not be of high magnitude or of great depth compared to that desired in the final product; and, consequently, the initial stage can be accomplished at a low shot velocity, preferably in the range of 24 feet per second to 30 feet per second. This low velocity initial stage of impact serves to protect the surface of the work against cracks.

When required, the second stage of my peening process is practiced to produce a greater depth of residual compressive stress. This is accomplished by peening with a higher velocity, and, if desired, a larger shot size in the second stage. The peening in the second stage is done under conditions selected in accordance with the cross sectional size or thickness of the component to be peened, the nature and hardness of the material of that component, and the requirements the component is to meet in service. In general, it may be said that a component of thin cross section requires only a shallow depth of residual compressive stress for best results and can be accomplished at a comparatively low velocity, or with small shot, or both. Thus, in very thin parts the first stage may be adequate without the practice of a second stage.

For maximum gain in fatigue strength work pieces or components of heavy or thick cross section require peening to produce a greater depth of residual compressive stress than in thin components, and this can be obtained with higher shot velocities, or larger shot sizes, or both, as compared to the practice of the method upon components of thin cross section. Economically, a high velocity of shot in the second stage is preferred because of the greater rapidity of processing with its use.

For materials of hardness in the higher ranges, such as 50Rc and higher, the depth of penetration of the residual compressive stress is less than in materials in the lower range. With such materials, the second stage of the method should be practiced with higher shot velocities, or larger shot, or both, than required for second stage processing of materials in the softer range for any given thickness of the material.

Consideration of the conditions under which the processed component is to operate are important in the practice of the method. Thus, where the service of a component requires it to sustain high degrees of bending or torsion stresses, it is desirable to process the component to secure a relatively deeper penetration of residual compressive stress than is required in components to which lesser bending and torsion stresses are to be applied. The deeper penetration of residual compressive stress can be accomplished by high shot velocity or the use of large shot, or both, particularly in the second stage.

Also, the method is applicable to compression stressing of metal shot used in shot peening or blast cleaning, as by repeatedly projecting the shot as produced against a member of equal or greater hardness at a velocity from 24 to 30 feet per second for a period of time sufficient to produce the desired residual compressive stress throughout the surface thereof.

The range of variation in the practice of shot peening according to my method is great because of the wide variety of materials, dimensions and use conditions; consequently, it is impossible to enumerate every variation. However, the practice of the method can be guided by reference to some specific examples from which the desired parameters or conditions in any specific case for which the method is to be used can be determined.

In the following examples a range of shot size and shot velocity is given for each. It should be understood that each example given represents a range of choice of conditions rather than a range for a particular application. It is good peening practice, where possible, to control the shot size and velocity to a reasonably uniform value: that is, to use one standard shot size at a substantially constant velocity in a given peening operation.

EXAMPLE 1

Steel leaf spring 1/16 inch thick, of a hardness in the range from 45Rc to 62Rc. The service required of the spring is to sustain an applied stress cycle entailing bending from zero to maximum tensile stress, and a long useful life under such conditions. By my method, a single stage of shot peening using substantially spherical shot of hardness of 55Rc to 60Rc in the size range from S-110 (0.011 inch diameter) to S-280 (0.028 inch diameter) impacting the work piece at a velocity of from 24 to 30 feet per second with substantially full coverage of the work will suffice. I have found that cracks are not likely to occur in the surface of such components and that the depth of residual compressive stress obtained by such processing is adequate for this thickness of the work piece.

EXAMPLE 2

Steel leaf spring ⅛ inch thick of hardness in the range from 50Rc to 62Rc. The service required of the spring is to sustain an applied stress cycle entailing bending from zero to maximum tensile stress. I first subject the piece to peening using shot of hardness of 55Rc to 60Rc in the size range from S-110 (0.011 inch diameter) to S-230(0.023 inch diameter) impacting the work at a velocity in the range of 24 to 30 feet per second, to secure substantially full coverage of the work piece. The work piece is then subjected to a second peening stage using shot of the same size and hardness range used in the first stage impacting the work at a velocity in the range from 233 to 90 feet per second, with the smallest shot impacting at a velocity higher in that range and smaller shot impacting at a lower velocity in that range. Practice of this example of the method eliminates likelihood of surface cracks and produces a depth of residual compressive stress adequate for the thickness of the component.

EXAMPLE 3

A steel leaf spring of a thickness of ¼ inch and a hardness in the range from 50Rc to 62Rc which in service requires a long life when subjected to an applied stress cycle entailing bending from zero to maximum tensile stress. This component is first subjected to shot peening using shot of hardness of 55Rc to 60Rc in the size range from S-110 (0.011 inch diameter) to S-330 (0.033 inch diameter) projected against the component at a velocity in the range from 24 to 30 feet per second to secure substantially full coverage of the component. The component is then subjected to shot peening using shot of hardness from 55Rc to 60Rc in the size range from S-170 to S-330 projected against the component at velocities in the range from 233 feet per second to 90 feet per second, with the velocity inversely related to the size of the shot used. Peening continues until full coverage of the component occurs.

EXAMPLE 4

A component of ½ inch thickness and a hardness of 50Rc to 62Rc is first subjected to shot peening using shot of a hardness of 55Rc to 60Rc in the size range from S-110 (0.011 inch diameter) to S-460 (0.046 inch diameter) projected against the work piece at a velocity in the range from 24 to 30 feet per second to secure substantially full coverage of the work. The work piece is then subjected to shot peening using shot of hardness from 55Rc to 60Rc in the size range from S-230 to S-460 projected against the work at a velocity in the range from 233 feet per second to 90 feet per second, with the velocity inversely related to the size of the shot used. Peening continues until full coverage of the surface of the work occurs.

EXAMPLE 5

A metal component of 1 inch thickness and of a hardness of 50Rc to 62Rc is subjected to a first stage of peening with shot of hardness from 55Rc to 62 Rc in the size range from S-110 to S-660 (0.066 inch diameter) at a velocity of 24 to 30 feet per second to secure substantially full coverage of the surface of the work piece. The work piece is then subjected to a second stage using shot of the same hardness and of a size in the range from S-460 to S-660 projected against the work piece at a velocity in the range from 233 feet per second to 90 feet per second until the entire surface of the work has been peened. The velocity of the shot is inversely proportional to the size of the shot used.

With regard to Example No. 5, the use of shot size of S-660 and the velocity of 233 feet per second are in the low range and higher velocity and larger shot size can be used, but limitations in currently available equipment dictate the shot size and velocity indicated. If equipment becomes commercially available to handle larger shot sizes at higher velocities than indicated, the range of shot size and velocity obtainable with such equipment could be determined readily by simple tests. Also, with respect to the process of Exampler No. 5, since the likelihood of occurrence of cracks on the surface of the work is influenced by the velocity of the shot, the same shot could be used in both stages of the process subject to the disadvantage that the use of large shot, such as S-660, at the low velocity of the first stage may require an extremely long exposure time in the first stage.

In considering the foregoing examples, it will be understood that they are illustrative and not limiting, and that they are effective in treating work pieces which may be subjected to all types of stresses, including complete reversal, as between tensile stress and compressive stress. Also, it will be understood that the velocity referred to in the examples relates to the velocity of shot projected in a direction substantially at right angles to the surface of the work piece. This does not mean that the shot peening must be accomplished with righ angle impact, but rather that, at a smaller angle of impact, the force of impact is reduced, and suitable compensation for such reduction must be made.

It will also be understood by those skilled in the art that, whereas in the examples, steel shot of high hardness (55–60Rc) is used at a very low velocity, it is also possible to use, in currently available equipment, shot of standard hardness (40–50Rc) at a higher velocity because the lower yield strength of shot of standard hardness allows a permanent deformation or yield to occur in the shot prior to yield in the work piece. Disadvantages of the use of shot of standard hardness are that additional peening equipment probably would be necessary to prevent the hard shot used in the high impact step of the method from becoming mixed with the softer shot, and that the cost of the peening operation would probably increase.

Another variation is to use cast iron shot in the first stage. The lower modulus of elasticity of cast iron shot would reduce the elastic radial tensile stress at the edge or margin of contact of the shot with the work at the instant of first yield.

These examples entailing the processing of materials of a hardness of the range from 50Rc to 62Rc entail a distinct departure from conventional processes of producing springs. Thus heretofore it has been futile to use metals of hardness of 58Rc or more because of the brittleness thereof and because of the extremely high notch-sensitivity and consequent loss of fatigue strength thereof. In other words, although the physical properties of ultimate strength and yield strength of material of this hardness are much higher than those of the conventional hardness of about 45Rc, the fatigue strength of the product is much less. Thus, the present method for the first time makes it possible to utilize the higher strength of materials of hardness commonly referred to as brittle materials: these include both high strength steels and other materials which have advantages but are limited in fatigue strength, such as titanium or any other material in which the fatigue strength is not in keeping with the advantages inherent in its physical properties.

The foregoing examples are given for components of uniform cross section but various thicknesses and will be recognized by those skilled in the art as making available for effective uses, such as springs, metals of a hardness which cannot be used with present processes. In other words, the foregoing examples reveal to those skilled in the field a process which tends to overcome the effect of brittleness and is highly effective when used in high strength steels.

The choice of components of uniform cross section was made for purposes of simplicity. Components of other shapes, such as coil springs, connecting rods, crankshafts, gears, etc. may benefit from this process with properly selected parameters correlated to or proportional to those herein stated.

It will be noted that the velocity of shot used in the first stage is very low and is lower than velocities conventionally used in blast cleaning and shot peening. Also it will be noted that in the first stage of the multistage processes the shot velocity rather than the shot size is the predominant factor in preventing cracks of the work piece.

Another application for the invention is its use to improve resistance to pitting of gear teeth. There is evidence that in many instances the initiation of pitting failure occurs below the surface where repeated shear stress due to applied tooth contact pressure is maximum. In other instances, it has been observed that pitting can start at the surface. Either condition can be met by using this shot peening method to provide a means of using through-hardened steel in gears instead of case hardened steel, both to increase fatigue strength and to increase pitting resistance. The case hardening of gears results in a very hard surface: for example, 58Rc and a relatively soft core. This gradient of hardness is accompanied by a moderate residual compressive stress at the surface and a corresponding gradient of stress in the case. This residual stress is the source of higher fatigue strength which permits the use of high surface hardness parts. By the present method a gear can be made of material having high hardness throughout its cross section by allowing the imposition of a layer of residual compressive stress of much higher magnitude at the surface and of controlled depth. This is an example of the great advantage of the method in being able to provide especially high fatigue strength by virtue of the utilization of high strength or brittle metals.

This invention is not limited to shot peening, but is also applicable to surface rolling. Such rolling involves plastic deformation or plastic internal flow in the same sense as with shot peening, but is produced by contact pressure between a roller and the work piece.

One example of the rolling process entails the rotation of a circular work piece, such as a shaft, on its axis, as in a lathe on whose tool post holder is mounted a unit containing a clevis which supports a roller for rotation on an axis substantially parallel to the axis of the work piece, and spring loaded to exert a measured force of the roller against the work piece. The roller is made of high strength steel and has a relatively small axial dimension: for example, ½ inch or less; and a small diameter: for example, 1 inch or less; and preferably has a uniform transverse peripheral curvature, such as a transverse radius of ¼ inch or less. The roller mounting assembly is advanced axially by the lead screw of the lathe under predetermined roller pressure against the work piece so that the roller contacts the work piece in an overlapping spiral path. The initial rolling action of stage entails application of a low pressure or load to the roller so that its contact with the work piece avoids occurrence of microscopic cracks in the work piece. The second stage of the process entails the application of a greater stress or load to the roller to create plastic flow in the work piece in the region of contact with the roller to obtain a favorable distribution of residual stresses in the work piece and greater fatigue strength. If desired, more than two stages of the rolling action can be practiced. The rolling method avoids limitations inherent in shot peening existing by virtue of limitations of the size and the velocity of the shot which can be used with available peening equipment. Thus the radii of curvature of the rollers (analogous to shot size) and the applied load (analogous to shot velocity) have a much broader scope of selection by machine design. However, processing by rolling has certain limitations in that while admirably suited for treating shafts or regularly machined surfaces it is impractical for processing work pieces having irregular surfaces or surfaces which would not be accessible to a roller under load.

For the purpose of illustrating the use of surface rolling in the sense described, a few examples are given below:

ROLLING EXAMPLE 1

A 1 inch diameter shaft with a hardness of 30Rc which requires reverse bending (rotation) in service and a long life is subjected to a rolling procedure using in a first stage traversing the surface of the work a roller of ½ inch diameter and a 1/16 inch transverse radius and subjected to a pressure or force of 12 pounds. A second stage of the process entails the application of a pressure of the order of 64 pounds at the roller as it traverses the surface of the shaft.

ROLLING EXAMPLE 2

A 1 inch diameter shaft having hardness of 40Rc requiring reverse bending (rotation) in service and a long life can be subjected to a rolling procedure using in a first step a roller of ½ inch diameter having a 1/16 inch tip radius applying a pressure of 50 pounds to the shaft, and using in the second step of the process application of a pressure of the order of 270 pounds by a roller to the shaft.

ROLLING EXAMPLE 3

A 1 inch diameter shaft having hardness of 58Rc which is to be used in large machines with high loads of a character usually requiring the use of a shaft of much larger diameter. This shaft will be through-hardened and tempered to 58Rc minimum and then surface rolled using a roller of ½ inch diameter and 1/32 inch tip radius. In the first stage of the method, a rolling pressure of 108 pounds is applied by the roller to the shaft. In the second stage of the process a pressure of the order of 560 pounds is applied by the roller to the shaft.

In each of the above examples it will be understood that the rolling pressure will be applied in each stage throughout the surface of the work piece incident to rotation of the work piece and progressive advance of the roller along and parallel to the work while subjected to the pressure stated. The load in the first stage of the rolling process can be closely approximated because it is necessary only to determine the load required for the shear stress to exceed the yield strength of the shaft or work piece. The load required in the second stage should impose a predominantly plastic internal flow in the region of roller contact rather than elastic deformation of the work piece, and for this reason the pressures stated for the second stage are approximate. It may be desirable to run tests to establish the optimum rolling conditions in each application, just as tests may be desired to establish optimum peening conditions in each application.

While the preferred procedures in the practice of the method have been indicated, it will be understood that the invention is not limited to the examples given but rather falls within the scope of the appended claims.

What I claim is:

1. A process of compression stressing a metal work piece by shot peening or surface rolling thereof to increase the fatigue strength thereof consisting of the step of compression stressing substantially the entire selected surface of the work piece by imparting compression stresses of a value so related to the thickness, the hardness and the notch sensitivity of the work piece as to avoid the formation of surface cracks during the peening or rolling operation and produce a distribution of residual stresses in the work piece favorable to increase of fatigue strength, and a second step of compression stressing said work piece following the first step by imparting substantially uniformly to the selected surface of the initially stressed work piece compression stresses of greater magnitude to produce a greater depth of residual compressive stress in the work piece.

2. The process defined in claim 1 wherein the work piece is progressively traversed in each step by a roller, the pressure exerted by the roller in the first step slightly exceeding the yield strength of the work piece near the surface and the pressure exerted by the roller in the second step being sufficient to produce predominantly plastic flow of the metal of the work piece at the region contacted by the roller.

3. The process defined in claim 1, wherein the second step entails substantially uniformly peening the selected surface of the initially stressed work piece by shot of such size projected at such high velocity that the same would damage such a work piece which had not been subjected to the first step.

4. The process defined in claim 3, wherein the metal work piece has a hardness in the range from 50Rc to 62Rc and a thickness in the range of ⅛ inch to 1 inch, and the second step entails peening with shot of substantially the same hardness as the work piece and of a diameter in the range from 0.011 inch to 0.066 inch, said shot being projected against the work piece at a velocity in the range from 233 feet per second to 90 feet per second selected in inverse proportion to the diameter of the shot.

5. The process defined in claim 1, wherein the surface of the work piece is progressively traversed in each step by a roller under pressure, each roller having a rolling diameter not exceeding substantially 1 inch and a transverse radius not exceeding substantially ¼ inch.

6. The process defined in claim 5, wherein the work piece is subjected to roller pressure in the first step in the order of 12 pounds for work pieces of a hardness of 30Rc to 108 pounds for work pieces of a hardness of 58Rc.

7. The process defined in claim 6, wherein the work piece is subjected to roller pressure in the second step in the order of 60 pounds for work pieces of a hardness of 30Rc to 560 pounds for work pieces of a hardness of 58Rc.

8. The method of increasing the fatigue life of a metal part which comprises compression stressing the surface of a metal part at a low intensity in a first step and thereafter further compression stressing the surface of said part in a second step at an intensity substantially greater than the intensity of said initial stressing thereof, said first step compression stressing being of an intensity to prevent the formation of cracks in the metal part during the first step and during higher intensity compression stressing in the second step.

9. The method defined in claim 8, wherein the first compression stressing of the part is of a magnitude to produce plastic flow of the metal and residual compressive stress at the surface of the part sufficient to protect the surface of the work against occurrence of cracks during the second compression stressing of the part to produce a greater depth of compressive stress in the part.

* * * * *